United States Patent [19]

Overton et al.

[11] 4,186,288

[45] Jan. 29, 1980

[54] SLIDE SWITCH

[75] Inventors: Arthur W. Overton, Raleigh; Allan J. Sykora, Cary, both of N.C.

[73] Assignee: Stackpole Components Company, Raleigh, N.C.

[21] Appl. No.: 938,934

[22] Filed: Sep. 1, 1978

[51] Int. Cl.[2] ..... H01H 3/04; H01H 15/10

[52] U.S. Cl. ..... 200/164 R; 200/16 D; 200/260; 200/332

[58] Field of Search ..... 200/16 A, 16 C, 16 D, 200/153 LB, 153 LA, 260, 252, 164 R, 165, 332

[56] References Cited

U.S. PATENT DOCUMENTS 3,914,570 10/1975 Lockard ..... 200/16 D

*Primary Examiner*—Frederick R. Schmidt

*Attorney, Agent, or Firm*—Brown, Flick & Peckham

[57] ABSTRACT

A switch housing covering an elongated base has a top wall spaced from a plurality of fixed contacts mounted along the base for engagement by a bridging contact carried by a slider inside the housing. The top wall of the housing is provided with a slot extending inwardly from one end and having a pair of side walls formed from downturned areas of the top wall, each of which is provided with an upwardly extending notch. A lever disposed in the slot normally extends above the housing, with the lower end of the lever provided with laterally projecting trunnions extending through the side wall notches. The lower end of the lever outwardly beyond the trunnions extends downwardly into engagement with the end of the slider for pushing the slider toward the opposite end of the base when the upper end of the lever is swung outwardly away from the underlying end of the housing.

4 Claims, 5 Drawing Figures

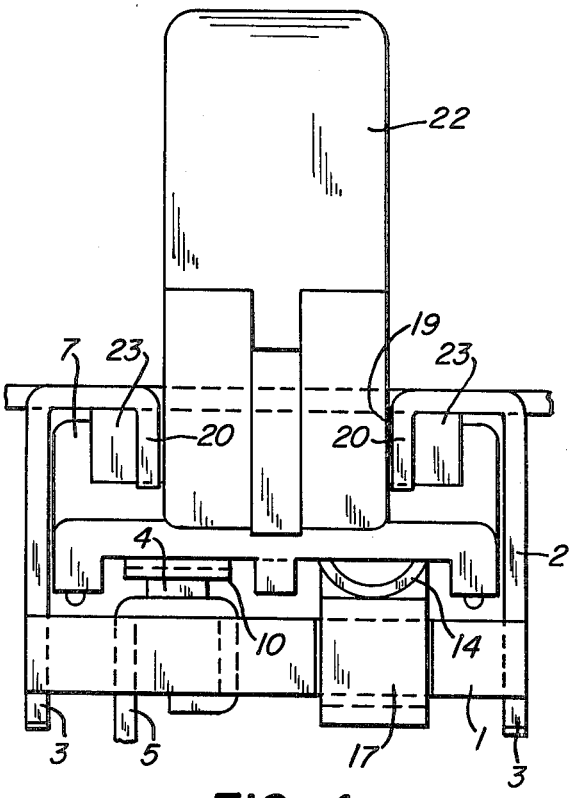
FIG. 4
FIG. 5
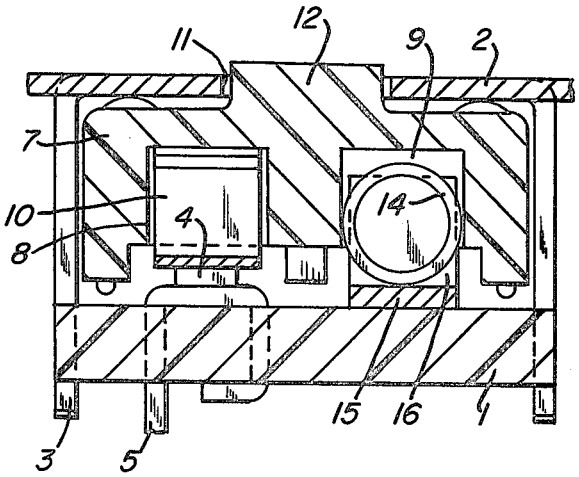
FIG. 3
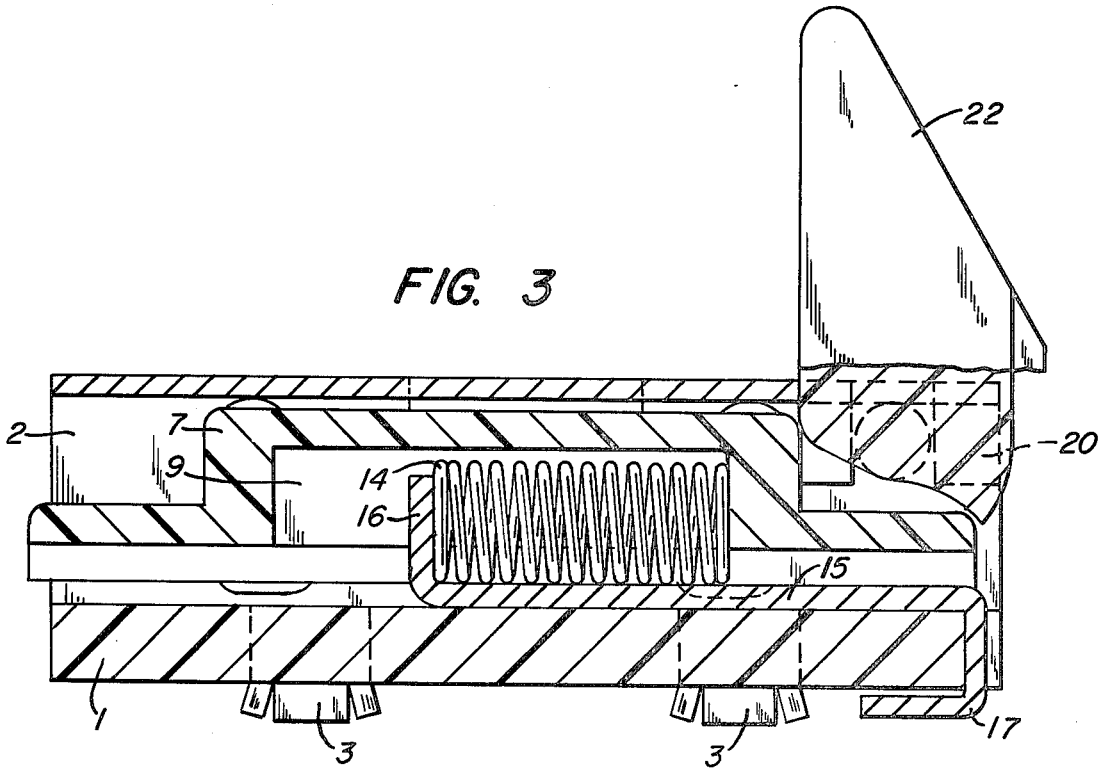

SLIDE SWITCH

It is among the objects of this invention to provide a slide switch, which can be operated in one direction by means of a lever and which has a simplified and inexpensive pivotal connection between the lever and the rest of the switch.

The preferred embodiment of the invention is illustrated in the accompanying drawings, in which FIG. 1 is a plan view of the switch;

FIGS. 2 and 3 are longitudinal views taken on the lines II—II and III—III, respectively, of FIG. 1;

FIG. 4 is an end view; and

FIG. 5 is a cross section taken on the line V—V of FIG. 1.

Figure 1:
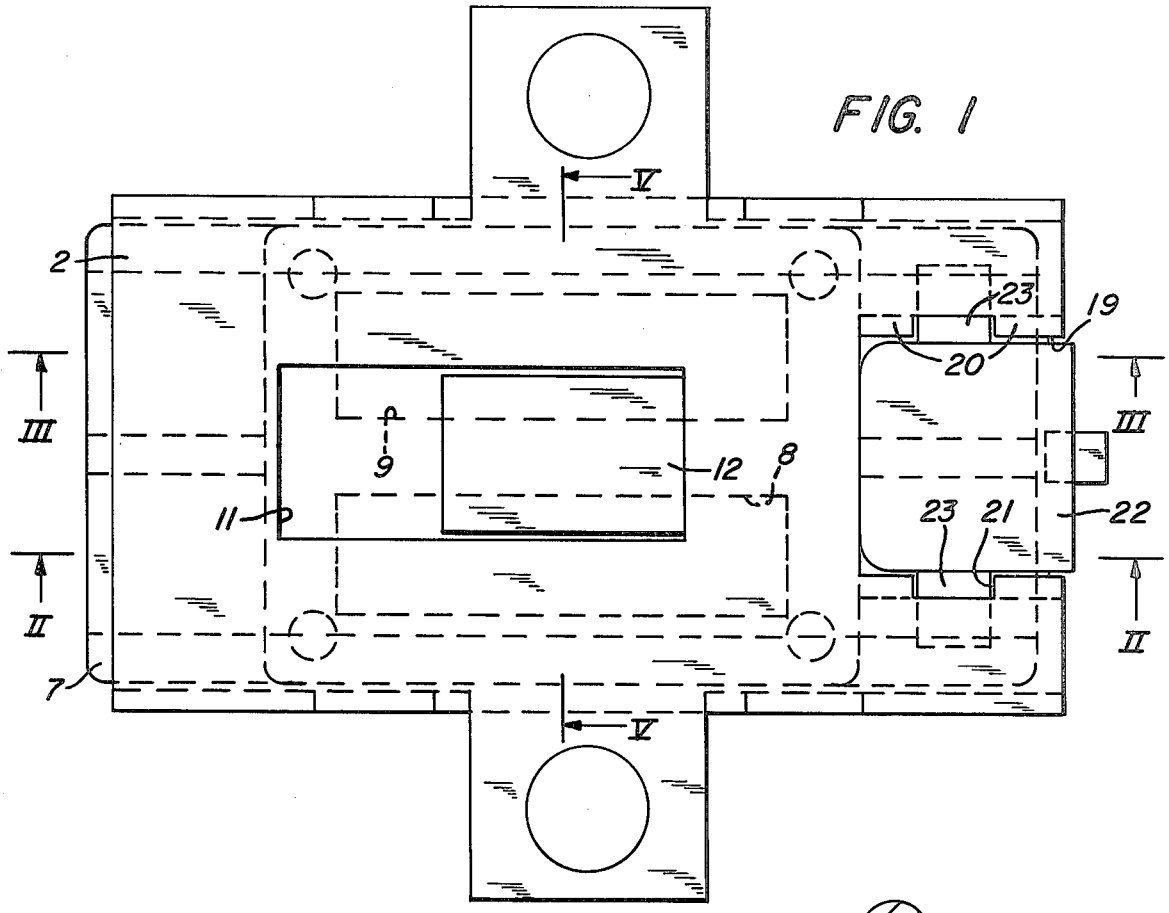

Referring to the drawings, an elongated rectangular base 1 of insulating material is covered by a metal housing 2 in the form of an inverted channel, the edges of which rest on the edges of the base and are held on it by tabs 3 extending through notches in the base in a well-known manner. The housing has a flat top wall spaced from the base and parallel to it. Mounted on the base and spaced lengthwise along it are two or more fixed contacts 4 joined to terminals 5 that extend down through the base for connection into an electric circuit.

Figure 2:
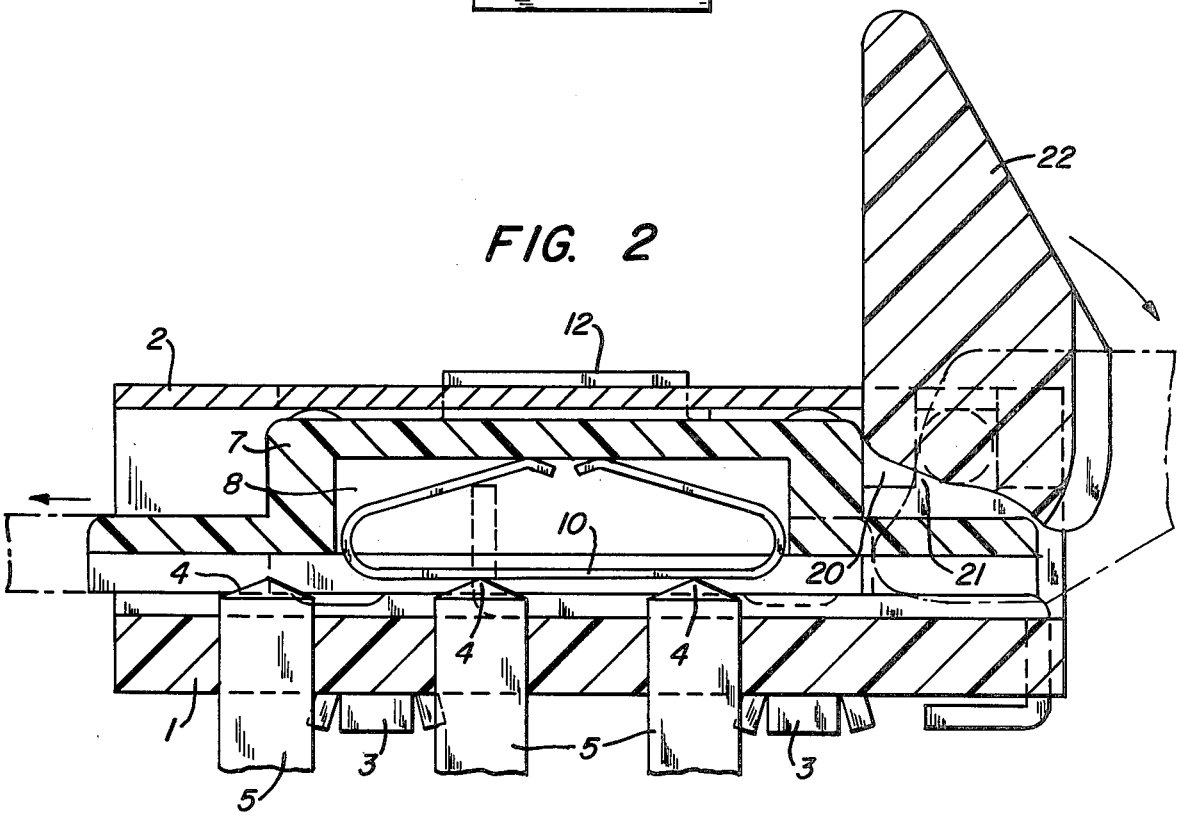

Inside the housing there is a slider 7, made of insulating material, which can move back and forth lengthwise of the base. The bottom of the slider is provided with at least one, and preferably two, upwardly extending recesses 8 and 9 that extend lengthwise of the base. As shown in FIGS. 2 and 5, recess 8 is directly above two of the fixed contacts 4 when the slider is at either end of its path of movement in the housing. Disposed in this recess is a bridging contact 10 that has a straight body portion engaging two of the fixed contacts, and end portions that are inclined upwardly and toward each other with their upper ends engaging the upper wall of the recess to press the bridging contact down against the underlying fixed contacts. The top wall of the housing may be provided with an opening 11, through which a projection 12 on the top of the slider extends. This projection can be used for moving the slider if desired. It also limits the distance the slider can move.

When the slider is provided with two recesses as shown, the second recess 9 contains a coil spring 14 as shown in FIGS. 3 and 5. One end of the spring engages an end wall of the recess while the other end of the spring engages a stationary abutment near the opposite end of the recess. The abutment is formed by a metal strip that has a straight body portion 15 extending along base 1 beneath recess 9. The inner end 16 of the strip is bent at a right angle to the base and extends up into the recess for engagement by the coil spring. The outer end of the strip is bent to form a hook 17 that extends down through a notch in the adjoining end of the base. The spring will normally hold the slider at one end of its path of movement. When the slider is moved to the opposite end of that path and released, the spring will return the slider to its original position.

It is a further feature of this invention that the switch is provided with a manually operated lever, by which the slider can be moved in one direction; namely, in the direction that compresses the coil spring. For this purpose the end of the top wall of housing 2 above the end of the base where hook 17 is located is provided with an inwardly extending slot 19. In forming this slot the top wall of the housing at opposite sides of the slot is bent downwardly to form parallel side walls 20 of the slot. Also, the central portion of each of these side walls is cut away to form an upwardly extending notch 21. Disposed in the slot is the lower end portion of a lever 22 that extends upwardly above the switch housing. Preferably, the lever is molded from a suitable plastic. The opposite sides of the lower end of the lever are provided with integral laterally projecting trunnions 23 that extend through notches 21 and into engagement with the lower surface of the top wall of the housing, to thereby form a pivotal connection of the lever to the housing. With this arrangement, the lever can be swung from its upright position outwardly away from the housing to a substantially horizontal position, as indicated in dotted lines in FIG. 2, the trunnions serving as the pivots for this purpose. In the upright position of the lever, it engages the inner wall of slot 19, which limits swinging of the lever toward the opposite end of the switch. The lower end of the lever, outwardly beyond its trunnions, extends downwardly into engagement with the underlying end of the slider.

OPERATION

When it is desired to move the slider toward the opposite end of the base so that the bridging contact will engage a different fixed contact, the upper end of the lever is swung away from the switch housing and this will cause the lower end of the lever to push the slider toward the opposite end of the base against the resistance of the coil spring. As soon as the lever is released, the coil spring will expand and thereby return the slider to its original position. In doing so, the slider will swing the lever back up to its normal upright position. It will be seen that in assembling the parts of this switch it is a very simple matter to slip the lever trunnions 23 up into notches 21 at the opposite sides of the housing slot while the slide is held at the opposite end of the base momentarily. The spacing between the base and the side walls 20 of slot 19 is great enough to permit the trunnions to be moved into position below the notches and then raised. No parts, other than the slider itself, are required in order to pivotally mount the lever in place. This means that there is a saving in parts and assembly time.

Although this switch has been described as if base 1 is at the bottom, that was done merely for convenience of description. It should be understood that the switch could be installed on its side or even bottom side up.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A slide switch comprising an elongated base, a metal housing covering the base and having a top wall spaced therefrom, a plurality of fixed contacts inside the housing spaced longitudinally of the base and mounted thereon, a slider inside the housing movable lengthwise of the base, a bridging contact carried by the slider for engaging said fixed contacts, the top wall of the housing being provided with a slot extending inwardly from one end of the housing, the top wall of the housing at opposite sides of the slot being bent downwardly to form side walls of the slot, each side wall being provided with an upwardly extending notch, and a lever disposed in said slot and normally extending above the housing, the lower end of the lever having integral laterally projecting trunnions extending through said notches and beneath said top wall, and the lower end of the lever outwardly beyond said trunnions extending downwardly into engagement with the end of said slider for pushing the slider toward the opposite end of the base when the upper end of the lever is swung manually outwardly away from said housing, including a spring for returning the slider toward said one end of the housing when said lever is released, and in which the slider holds said trunnions up in said notches when the slider is at said one end of the housing.

2. A slide switch according to claim 1, in which said slider is provided with a pair of parallel longitudinal downwardly opening recesses, and said bridging contact is disposed in one of the recesses, the switch including an abutment member secured to said base and projecting into the other recess adjacent the end thereof farthest from said slot, and a coil spring in said other recess compressed between the other end thereof and said abutment member to return the slider toward said one end of the housing when said lever is released.

3. A slide switch according to claim 2, in which said housing has open ends, said abutment member is a metal strip having a straight body portion extending along said base beneath said other recess, an end portion hooked over the end of the base beneath said slot, and an opposite end portion extending up into said other recess and engaged by said spring.

4. A slide switch according to claim 2, in which the slider normally is pressed by said spring against the lever to hold it erect against the inner wall of said slot.

* * * * *